US006256902B1

(12) United States Patent
Flaherty et al.

(10) Patent No.: US 6,256,902 B1
(45) Date of Patent: Jul. 10, 2001

(54) APPARATUS AND METHOD FOR DESICCATING AND DEAGGLOMERATING WET, PARTICULATE MATERIALS

(76) Inventors: John R. Flaherty, 532 Spruce St. #8, Philadelphia, PA (US) 19106; Bradley P. Gehring, 210 Galahad Pl. North, Hudson, WI (US) 54016

( * ) Notice: Subject to any disclaimer, the term of this patent is extended or adjusted under 35 U.S.C. 154(b) by 0 days.

(21) Appl. No.: 09/329,980

(22) Filed: Jun. 10, 1999

Related U.S. Application Data

(60) Provisional application No. 60/106,927, filed on Nov. 3, 1998.

(51) Int. Cl.[7] ..... F26B 7/00

(52) U.S. Cl. ..... 34/379; 34/381; 34/384; 34/387; 34/61; 34/68; 110/222; 110/224; 210/609; 210/769; 210/771

(58) Field of Search ..... 34/379, 380, 381, 34/384, 387, 60, 61, 68; 110/220, 222, 224, 341; 210/609, 768, 769, 770, 771

(56) References Cited

U.S. PATENT DOCUMENTS

| | | | | |
|---|---|---|---|---|
| 3,769,921 | * | 11/1973 | McMullen . | |
| 4,213,407 | * | 7/1980 | Headley | 110/346 |
| 4,290,269 | * | 9/1981 | Hedstrom et al. | 60/670 |
| 4,335,663 | * | 6/1982 | Terrell | 110/264 |
| 5,431,702 | * | 7/1995 | Schulz | 44/552 |
| 5,846,425 | * | 12/1998 | Whiteman | 210/606 |
| 5,863,429 | * | 1/1999 | Bahr | 210/385 |

* cited by examiner

*Primary Examiner*—Pamela Wilson
(74) *Attorney, Agent, or Firm*—Joseph E. Gerber; John P. Costello

(57) ABSTRACT

An apparatus and method for drying and deagglomerating substances of finely-divided solids suspended in a fluid medium. The apparatus includes the basic components of a phenumatic friction dryer, a flash dryer and a ring dryer.

77 Claims, 7 Drawing Sheets

APPARATUS AND METHOD FOR DESICCATING AND DEAGGLOMERATING WET, PARTICULATE MATERIALS

This application claims the benefit of Provisional Patent Application Serial No. 60/106,927 filed Nov. 3, 1998.

BACKGROUND OF THE INVENTION

1. Field of the Invention

The present invention relates generally to apparatus and methods for drying and deagglomerating substances comprised of finely-divided solids suspended in a fluid medium, and it more specifically relates to apparatus and methods for processing wet, pasty, sticky substances, such as municipal sludge, into a workable, powdered product.

2. Description of the Related Art

The primary problem currently facing every municipal wastewater treatment facility is the cost-effective, energy-efficient and environmentally-sound disposal of sludge, the end product of wastewater processing. North America produces about two pounds of sludge daily for every man, woman and child. In the United States, there are currently approximately 35,000 wastewater treatment plants, with an estimated 2,500 slated for construction within the next 10 years to accommodate the growing population base. The EPA currently estimates that approximately 15,000 of these are privately-owned, and that these alone generate 110–150 million wet tons of sludge cake per year. Annual costs for processing this waste are in excess of five billion dollars.

Historically, municipal sludge management disposal programs relied upon: land filling; surface disposal; incineration; ocean dumping (banned in the United States in 1992); and/or, beneficial reuse through land application. Each of these methods can be relatively inexpensive, but each can have undesirable aspects which result in a negative long-term cost to the environment.

The major portion of the United States' sludge has been sent to landfills. As a result, valuable landfill space for large communities has been either so reduced, or the quality of the sludge cake is so undesirable, that a great proportion of the nation's sludge is now hauled a considerable distance overland before disposal. For example, New York City sends 20% of its sludge output to the range lands of Texas. Portland, Oreg. trucks approximately 75,000 tons per year over 200 miles to Hermiston, Oreg. to be land-applied for beneficial reuse. Although land-application for beneficial reuse has heretofore been the best current alternative, even this has drawbacks, including substantial fuel and personnel costs, and wear-and-tear on roads.

Another substantial portion of the waste in the United States has been sent to surface disposal sites. Surface disposal sites include monofills; surface impoundments and lagoons; waste piles; dedicated disposal sites; and, dedicated beneficial use sites.

However, a large number of states now have site restrictions or management practices governing sludge disposal. And federally, the Clean Air Act, which governs sludge incineration and the disposal of its residual ash, has recently been amended (the "Clean Air Act Amendments") to levy stricter air emission measures for incineration. Further, in 1993 the EPA published the 40 CFR part 503 Sludge Regulations (503 Regulations) employing the EPA's "exceptional quality" sludge program. The 503 Regulations established "Standards for the Use or Disposal of Sewage Sludge" applicable to all wastewater treatment facilities.

The 503 Regulations establish requirements for the final use or disposal of biosolids when biosolids are: applied to land to condition the soil or fertilize crops or other vegetation grown in the soil; when they are placed on a surface disposal site for final disposal; or, when they are fired in a biosolids incinerator. The 503 Regulations also direct that if biosolids are placed in a municipal solid waste landfill, they must meet the provisions of 40 CFR Part 258 which covers, in great detail, all aspects of establishing, maintaining and monitoring such landfills. In light of the foregoing, almost all communities are pursuing alternatives to incineration and landfilling.

"Land application for beneficial use" is the application of biosolids to land, either to condition the soil, or to fertilize crops or other vegetation grown in the soil. Biosolids can be beneficially land-applied on agricultural land, forest land, reclamation sites, golf courses, public parks, roadsides, plant nurseries and home land and gardens. Under the 503 Regulations, biosolid products that meet stringent requirements, including sufficiently low concentrations of certain pathogens and pollutants, and minimal attractiveness to disease vectors such as insects and rodents, are considered by the EPA to be Class A, "Exceptional Quality" biosolids. Class A biosolids are treated by the EPA in the same manner as common fertilizers; thus, they are exempt from federal restrictions on their agricultural use or land application. Biosolids falling short of the highest EPA standards may nevertheless qualify as Class B biosolids.

Biosolids that meet Class B requirements may also be applied to the land for beneficial use, but are subject to greater record keeping, reporting requirements and restrictions governing, among other items, the type and location of application, and the volume of application. Biosolids applied to the land for agricultural use must meet Class B pathogen levels and, if applied in bulk, require an EPA permit.

The 503 Regulations subject surface disposal to increased regulation by requiring, among other things: restricted public access; run-off and leachate collection systems; methane monitoring systems; and, monitoring of, and limits on, pollutant levels. In addition, sludge placed in a surface disposal site is required to meet, at least, Class B requirements.

Over the past few years, there has been a movement toward surface disposal of wet sludge. However, in large metropolitan areas and rural communities alike, proposals to land-apply wet sludge have been met with great resistance from the public. Factors affecting the acceptance of land-application are local geography, climate, odors, contaminants, land use, transportation costs and regulatory constraints.

Thus, the current 503 Regulations-compliant alternatives in municipal sludge disposal are: to destroy it through incineration; to land-apply it under heavy public scrutiny and an overbearing regulatory scheme; to convert it to a more desirable form through composting; or, to reduce the volume of sludge using drying methods that have heretofore been exceedingly costly. Overall, drying would be most desirable, were it not for the cost in fuel and expensive equipment.

The challenge in drying a pasty, sticky, gelatinous and difficult-to-handle material like sludge is in removing the moisture trapped inside. Typically, wet sludge cake is processed to a 20–25% solid through dewatering methods such as centrifuges and belt filter presses.

The current state of thermal-drying technology in the wastewater treatment industry is dominated by two heat drying technologies: direct and indirect. Direct drying technology puts hot air in direct contact with the biosolids during the drying process. Indirect drying technology causes the biosolids to come into direct contact with a heated surface, as opposed to hot air.

Currently there are two direct drying systems in the marketplace that employ a rotary drum, triple pass dryer, with provisions for recycling the majority of the hot air after removal of water vapor through condensation or other means: the Andritz-Ruthner DDS and the Swiss Comby system. The Andritz-Ruthner DDS is representative of all drying systems in this class. It can produce roughly 59 tons of 90%-dry biosolids per day. However, the cost for accomplishing this is high—approximately $179 per dry ton. Further, including accessories, the base cost of the Andritz-Ruthner DDS, alone, is currently approximately $8,680,000. Yet it also requires costly million-dollar scrubber systems for abatement of volatile organic compounds and nuisance odors in its exhaust stream. And, due to its complexity, exceedingly long construction times from start to finish are common.

In the category of indirect dryers, the current leader is the Komline-Sanderson (KS) dryer. The KS dryer has two rotating assemblies that convey biosolids through the dryer vessel. Each rotating assembly consists of a hollow shaft with paddles attached at regular intervals along its length. Steam is circulated through the hollow shaft and the jacketed shell of the dryer vessel to evaporate water from the biosolids being conveyed through the dryer. KS's largest dryer has a 40-ton per day capacity with a $213 per dry Ton cost.

The KS Dryer system is not appropriate for start/stop, one or two shift per day operation because of the two to three hours of time needed to start up and shut down the equipment. Further, the acquisition cost of the KS system, based upon capacity, is in excess of $10,000,000, including lengthy and costly on-site construction. Similarly, as with the Andritz-Ruthner DDS, the KS dryer requires costly, million-dollar scrubber systems for air abatement.

Dry Vac Environmental (Dry Vac) manufactures a Vacuum Filter Press (VFP) drying system, which is considered an indirect drying technology. The VFP is an adaptation of a recessed filter plate press, a conventional dewatering device which typically produces an 18%–22% dry product. The filter plate press, a batch-dewatering device, has met with limited acceptance among U.S. wastewater treatment facilities, which prefer continuous dewatering devices. In the VFP drying system, dewatering occurs by filtration as the biosolids are pumped into the filter press under pressure. Hot water is circulated through the filter press, heating the biosolids "cake" and expanding the membrane. The dried biosolids are then discharged by gravity, as the plates are mechanically separated, one filter plate at a time. Although Dry Vac's VFP drying system can produce a 90% dry product, to date, the technology has not been proven on a large-scale application. Additionally, due to the "batch" cycle of the VFP (5–6 hours), the press-emptying step and the initiation of the next operating cycle need to be monitored closely by personnel. The VFP is also handicapped by the need for frequent repair of system components. Other drawbacks of the VFP include the need for ferric chloride or lime in the solids conditioning process; these are costly and require constant housekeeping.

Another direct-drying system technology is the gas-fired rotary kiln. There are several disadvantages to this technology. First, the cost to a municipality to construct the kiln on-site is prohibitive. In 1992 the City of Tampa, Fla. spent $18 million to construct and install its gas-fired kiln. In 1994, the City of St. Petersburg, Fla. constructed its twin at a similar cost. Second, this drying process does not recoup or recycle any of its sensible and latent heat in the air stream and condensate. Thus, it is difficult, if not impossible in some states to obtain a permit to operate these systems. Third, although the gas-fired rotary kiln can dry municipal sludge to a 90%-dry product, the cost is extreme—approximately $250 per dry ton.

The Zimpro process bypasses the initial dewatering stage as the wastewater slurry is pumped into its boiler system. The boiler tank initially boils off the moisture followed by a second stage chamber where steam heats the sludge to a 90% dry product. The Zimpro steam dryer technology, like the rotary gas-fired kiln technology, is hard to permit, requires high maintenance and has a high unit cost. However, the real drawback to the Zimpro system is that it is capable of handling only small volumes of sludge.

The Hosokawa Bepex Corporation based in Minn., Minnesota owns two technologies for drying sludge slurries and cakes. The first is an established technology of pulse combustion that emerged in Germany during WWII. This drying system uses high sound levels generated by a Unison pulse combuster to enhance the drying of sludge slurries. The pulse combustion provides heat as well as motive force for atomization.

The Unison system utilizes heated air of 1200°–2400° F. as the drying medium creating a brief residence time. Pulse combustion is a low production system (two (2) tons/hour) at an erected and running cost of more than two (2) million dollars. Prototype work in this area has been minimal due to low production and high capital costs.

Hosokawa Bepex also manufactures a Torusdisc for heating and drying municipal sludge. Denver Screw, another competitor, makes a similar device. Both systems use heat to transfer fluids such as steam or hot oils through hollow screws within a jacketed vessel. Rotor speed controls residence time and a bone dry product results. However, these systems are low volume, and, the wear factor of the screws and the maintenance of the plumbing are high. Additionally, because of the necessary high temperature of the process heat, the organic value of the end product is destroyed.

F.D. Deskins Company's (Deskins) has a new sand dewatering and drying bed design that is quite effective to produce a 90% dry cake the texture of a potato chip. The capital cost is minimal, but the space required and the odors are prohibitive for major municipalities. The drying is accomplished through a solar/evaporative process that only works seasonally in hot climates. The Deskins system is limited to small, remote, warm climates.

Carver Greenfield is a similar technology utilizing hot oils and steams for sludge drying. This system became fashionable in the middle to late 1980's; but because its peak capacity peaked out at two (2) tons per hour (tph) feed rate, it is no longer popular.

In addition to all of the foregoing, a myriad of new wastewater treatment technologies are being developed for small-scale operation. Some of these employ ultrasonic, microwave, additional adapted plate and frame technology, and radiant heat processes. However, neither these new technologies, nor those described further above, meet the present and future high-volume sludge-processing needs of the major wastewater treatment facilities throughout the world. Indeed, virtually every wastewater treatment facility is looking for an economical, energy-efficient and environmentally-sound technology which dries municipal sludge and recycles its biosolids end product.

SUMMARY OF THE INVENTION

The apparatus and method of the invention are adapted to overcome the abovenoted shortcomings and to fulfill the stated needs.

The apparatus, in its preferred embodiment, is comprised of three primary components: a pneumatic friction dryer; a flash duct dryer; and, a ring dryer. The pneumatic friction dryer comprises an elongate shredding conduit, with means at its upstream end for driving sludge cake therethrough at high speed along with high-pressure gas, e.g. air. The elongate shredding conduit's downstream end opens into the flash duct dryer, which is a larger-diameter conduit connected to the ring dryer. The ring dryer is a toroid ring which may include one or more deagglomeration tubes directing high-speed gas generally transverse to the direction of process gas-flow in the ring. Means to effect back-mixing of dry product with incoming sludge cake may also be provided.

The inventive method is a direct-drying process which, first, comprises the step of driving sludge cake through the elongate shredding conduit with heated, high-pressure, high-speed gas for a sufficient time and distance to produce a shredded, partially-dried output product. That output product emerges at high speed and pressure into a suddenly lower-pressure environment in the flash duct. The partially-shredded product is broadcast out of the elongate shredding conduit's end and into the flash duct in a cone-shaped pattern. This begins to classify the particles of the product; the heavier, wetter, more agglomerated material follows an axial path, while the lighter, drier particles fans outward toward the outside of the cone. This output is directed into the ring dryer, where the heaviest, wettest particles in the cone are caused to collide, roughly perpendicularly, with the heaviest, wettest particles remaining in the ring's toroid circuit. By repeated collisions and continued circulation within the ring, further drying and particle classification take place, ultimately producing a uniform output product. Some of that output product may be back-mixed with the incoming sludge cake to achieve, ultimately, a more consistent input product, higher-volume material loading to the system, easier material handling, and greater overall drying efficiency.

The inventive apparatus and method take advantage of the finding that the more quickly incoming material can be reduced to singularity, i.e. the smallest possible individual particles of material, the higher the material to air ratio, and the greater the resulting drying efficiency of the system. Through synergistic combination of collision and classification patterns, the inventive apparatus and method achieve singularity more quickly, and at lower cost, than competing systems.

Thus, the inventive apparatus and method synergistically combine three separate drying disciplines to remove moisture in a convective, adiabatic mode, taking advantage of the fact that surface moisture of a material in gas suspension can be removed with less energy cost, less time and lower temperatures than entrained moisture. In adiabatic drying, all the heat and energy is utilized in the moisture change in state, rather than elevating the product temperature. This preserves the integrity of the biosolids while meeting pathogen reduction requirements. It also has the beneficial result of lowering overall process temperatures in comparison with competing systems, thus eliminating the need for the expensive refractory duct linings normally required in those higher-heat systems.

Processing municipal sludge with this apparatus and method continually creates new surface area in the sludge cake as it is being shredded, thus exposing entrained moisture to process-gas in a cost-effective and energy-efficient manner. The apparatus employed in drying and deagglomeration is entirely pneumatic, and thus reliable and low-maintenance. And, the use of pneumatics throughout the entire product-processing cycle permits sludge, which is inherently pasty, sticky and difficult-to-handle, to be shredded, dried, blended, and classified with great efficiency and minimal maintenance to the system.

One particular aspect which helps the inventive apparatus and method achieve efficiencies greatly in excess of what might be expected from the combined components is the discovery that, due to the high shredding effectiveness of the pneumatic friction-drying, shredding conduit herein, the gas volume needed through the deagglomerator tubes of the toroidal ring dryer may be greatly reduced, and in some cases may even be eliminated altogether, in comparison with what is normally required in conventional use of a toroidal ring dryer. This innovation, alone, permits significantly higher material to process-gas ratios, resulting in higher thermal efficiency, lower horsepower requirements and, therefore, significant savings in energy and other costs.

Ultimately, the inventive apparatus and method are capable of converting common municipal sludge into a 90% to 98%-dry, Class A biosolid, beneficially reusable as a fertilizer, filler or fuel. And, this is accomplished at roughly half the capital cost of competitive direct and indirect-drying systems. Also, as there is a significant associated weight reduction between the raw and final products, the apparatus and method disclosed and claimed herein significantly lower biosolid shipping, handling, and landfill costs.

All of the forgoing attributes combine in the inventive sludge drying apparatus and method such that, when rendered in the form of a plant able to process 10 tons of 25%-dry sludge per hour, the yield is approximately 63 tons of 90%-dry Class A biosolid per day, at a cost of approximately $118 per dry ton.

Thus, it is an object of the present invention to provide high-throughput sludgedrying apparatus having low purchase, installation, start-up, operation and maintenance costs.

It is a further object of the present invention to provide sludge-drying apparatus which does not require additional expensive scrubbers and/or other accessories to comply with environmental regulations.

Yet another object of this invention is to provide sludge-drying apparatus which does not require long start-up and shut-down times, as with systems employing indirect drying methods.

Yet a further object of the invention is to provide a sludge-drying apparatus and method able to process high volumes, e.g. one to ten tons of sludge per hour, at approximately 30% less cost per dry ton of product, in comparison with the most efficient competitive high-volume systems and methods.

Still further objects of the present invention are to provide a sludge-drying method and apparatus which require minimal space, minimal attention from personnel once in operation and which do not require addition of conditioning compounds such as ferric chloride, or lime, to the product during processing.

Another object of the present invention is to provide sludge-drying apparatus having the other above-described attributes, which is also able to recoup or recycle its sensible and latent heat in the gas stream and condensate.

And, it is also an object of the present invention to provide a sludge-drying apparatus and method able to keep heat transfer to the biosolid low, while still driving off the moisture, so that the organic value of the end product is preserved, and volatile organic compound (VOC) emissions are kept to a minimum.

Yet additional objects of the present invention are to provide a sludge-drying apparatus and method able to work in all climate conditions, and able to keep objectionable odors exiting the system to a minimum.

And, alternative objects of the invention include providing processing apparatus and methods to various industries where wet, sticky, pasty and/or agglomerated products, by-products or waste products need to be dried and deagglomerated. Such industries include those which produce food and beverages; paper and pulp; fertilizer; animal products; mined ores and minerals; and, cement.

Other alternative objects of the invention include providing apparatus and methods of producing renewable energy resources, such as for electric power plants, and the like.

Still further objects of the inventive sludge-drying apparatus disclosed herein will be apparent from the drawings and following detailed description thereof.

DESCRIPTION OF THE PREFERRED EMBODIMENT

Figure 1:
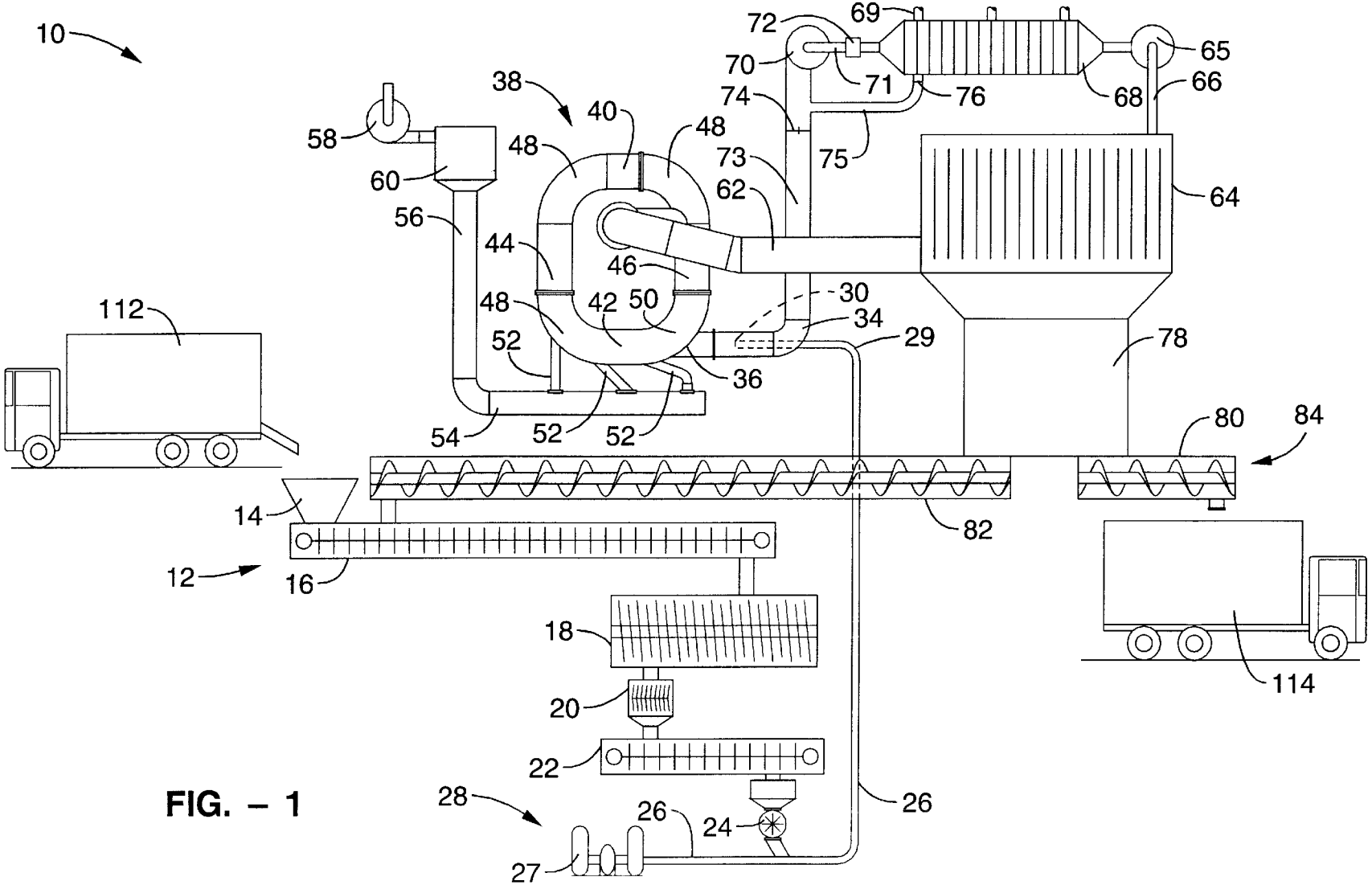
FIG. 1 is a diagrammatic representation of a municipal sludge drying plant including the desiccating and deagglomerating apparatus of the invention.

Referring now specifically to the drawings, FIG. 1 shows a municipal sludge processing plant 10 including the inventive apparatus. The infeed end 12 of plant 10 includes a weigh hopper 14 over shaftless screw-feed conveyor 16, which leads to mixing chamber 18 and shredder 20.

Mixer 18 may be of any type known in the art able to blend wet and dry materials. It preferably consists of a cylindrical chamber with rotating knives (not shown) able to continually slice through materials. Shredder 20 is preferably of a known type having rotating paddles (not shown) able to force material through screens to facilitate mixing, shredding and conditioning of material.

Tubular drag conveyor 22 connects shredder 20 with rotary feeder 24. Rotary feeder 24 serves as an infeed airlock into elongate, tubular shredding conduit 26.

Rotary blower 27, at the upstream end 28 of elongate shredding conduit 26, drives air at high speed past the point where rotary feeder 24 feeds into elongate shredding conduit 26. Rotary blower 27 is preferably a Roots Model No. 624 RCS, able to deliver approximately 2050 cfm to elongate shredding conduit 26.

Elongate shredding conduit 26's interior and linear dimensions have preferred ranges. In a 10 ton per hour (tph) sludge processing plant, an elongate shredding conduit 26 with an 8-inch inside diameter and a 40-foot length has yielded satisfactory results. It has been empirically determined that an elongate shredding conduit 26 having a length in excess of approximately 30 times its own inside diameter is necessary to achieve the objects of the invention.

Elongate shredding conduit 26 includes an epoxy lining (not separately shown) to reduce friction and wear from materials passing therethrough.

It may also be desirable to include a sweeping-radiused, right-angled bend 29 adjacent the downstream end of elongate shredding conduit 26. This is shown diagrammatically in FIG. 1 as being a bend lying in a vertical plane although, in practice, bend 29 may be disposed in whatever plane best fits the overall configuration of the plant and the components adjacent to elongate shredding conduit 26. Most commonly, it is expected that bend 29 will be entirely within a horizontal plane.

The downstream terminal end, terminus 30, of elongate shredding conduit 26 projects into flash duct 32. Flash duct 32 is generally cylindrical, and coaxial with downstream terminus 30. Upstream end 34 of flash duct 32 receives return process air from farther down-stream in plant 10. Downstream extent 36 of flash duct 32 is in fluid communication with toroidal ring dryer 38, further described below.

In a 10 tph plant, flash duct 32 is preferably approximately 10 feet in length, and its preferred inside diameter is approximately 18 to 30 inches. The distance elongate shredding conduit 26's terminus 30 needs to project into flash duct 32 may vary in accordance with certain product input conditions, output needs and process parameters, as further discussed below. However, it has been generally determined that positioning elongate shredding conduit 26's downstream terminus 30 approximately 3.5 feet from downstream extent 36 of flash duct 32 produces satisfactory initial results in a 10 tph plant.

Adjustment of the distance of which the terminus 30 of elongate shredding conduit 26 projects into flash duct 32 may be accomplished by adding pipe sections to, or removing sections from, elongate shredding conduit 26. And, other means of accomplishing this will be readily apparent to those skilled in the art. But, in any case, it appears that the critical distance to monitor and adjust in pursuing optimum system output is the distance between elongate shredding conduit 26's terminus 30 and flash duct 32's downstream extent 36. The overall length of flash duct 32, and the distance between upstream end 34 of flash duct 32 and conduit terminus 30, need only be sufficient to provide a fair range of adjustability between terminus 30 and flash duct downstream extent 36.

For convenience hereinbelow, the combination of flash duct 32 and terminus 30 of elongate shredding conduit 26 are sometimes collectively referred to as "injector 37." And, herein and in the claims, the entirety of elongate shredding conduit 26 and its downstream terminus 30 are collectively referred to as a "pneumatic friction dryer" (not separately numbered).

Figure 2:
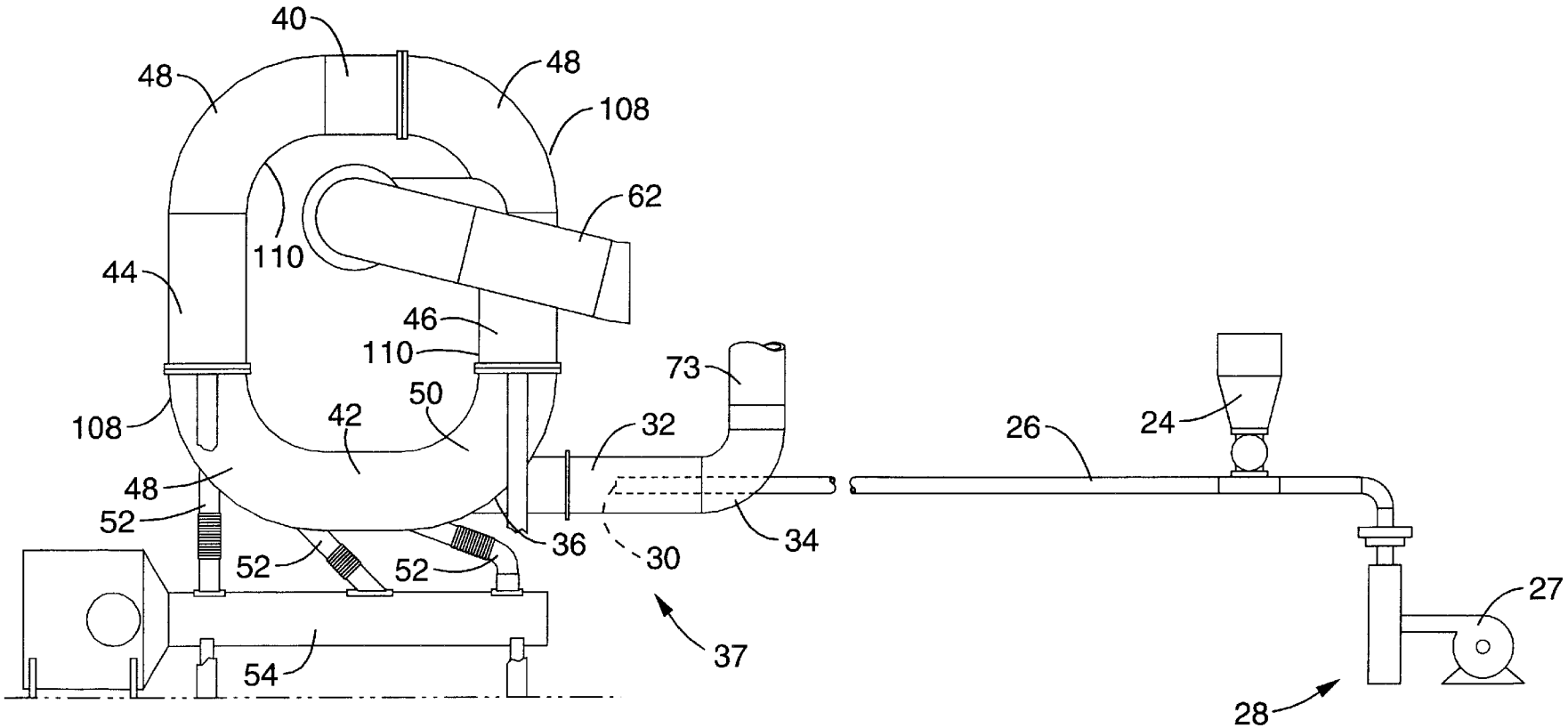
FIG. 2 is a side elevation view of the injector and toroidal ring dryer portions of the plant of FIG. 1.

As shown in FIG. 2, toroidal ring dryer 38 is an upstanding, tubular, slightly oblong structure. In a 10 tph plant, toroidal ring dryer 38 is roughly 16 feet wide and 25 feet tall, constructed of 42-inch inside diameter insulated duct sections. Its upper and lower tubular portions 40 and 42, and its first and second tubular side portions 44 and 46, are arranged relatively rectilinearly to form a continuous duct. Sweeping, 90-degree corner portions 48 tie upper, lower and side portions 40, 42, 44 and 46 together.

Flash duct 32's downstream extent 36 mates with toroidal ring dryer 38 at one of ring dryer 38's lower corners, that corner being generally designated herein as inlet corner 50. Toroidal ring dryer 38's lower tubular portion 42 is substantially linearly-aligned with flash duct 32.

A series of deagglomeration nozzles 52, all in a single vertical plane, enter the underside of toroidal ring dryer 38's lower tubular portion. Nozzles 52 are in fluid communication with the interior of toroidal ring dryer 38. As shown in FIGS. 1 and 2, deagglomeration nozzles 52 are peripheral to the body of toroidal ring dryer 38. The longitudinal axis of each nozzle is set at a tangent to the plane of toroidal ring dryer 38's surface. However, as further discussed below regarding their function, nozzles 52 are generally nonparallel.

Toroidal ring dryer 38 and nozzles 52 are components which are already well-known in the particulate material-drying arts. And, they are currently readily-available from several commercial sources. In practicing the invention, satisfactory results have been achieved in a 10 tph plant using a "Thermajet 42" ring dryer manufactured by Fluid Energy Aljet Systems.

Deagglomeration nozzles 52 are contiguous with a common manifold 54 fed by first hot air duct 56. Centrifugal blower 58 and first burner 60 reside at the upstream origin of first hot air duct 56. Centrifugal blower 58 and first burner 60 should be able to deliver 20,000 cfm, 900-degree Fahrenheit air to duct 56 at 2 psi. A 300 horsepower motor/fan package available from Spencer Turbine Company as Model No. RB 804, and a Fluid Energy Aljet propane-fired burner, model no. 967-98-004, capable of an output of approximately 10,000,000 BTU's have been used with success in a 10 tph plant.

As shown in FIG. 1, product output duct 62 is in fluid communication with toroidal ring dryer 38 on one end, and baghouse 64 on the other. Baghouse 64 is an updrafting, product drop-out filter. Exhaust fan 65 is in-line between exhaust duct 66 from baghouse 64, and heat exchanger 68. Exhaust fan 70 is preferably a Buffalo Forge fan Model No. HDL 1085-25CW360D driven by a 400 hp, 1785 rpm Toshiba motor. Exhaust stacks 69 rise from heat exchanger 68.

Plug fan 70 is on the opposite side of heat exchanger 68 from the exhaust circuit 65, 66 and 69; i.e., plug fan 70 is on the fresh air side. Intake duct 71 connects plug fan 70 and heat exchanger 68, and includes an in-line burner, second burner 72. Return air duct 73, from plug fan 70, is contiguous with upstream end 34 of flash duct 32.

Plug fan 70 is preferably a 50 hp Aerovent fan capable of delivering 30,000 to 35,000 cfm at 6" wg. Second burner 72 is preferably propane-fired, and capable of an output of approximately 10,000,000 BTU's. Burner 72 should also be capable of heating air flowing to and through plug fan 70 to approximately 400 degrees Fahrenheit.

Return air duct 73 preferably includes isolation damper 74, operative to, at least, partially close off return air duct 68.

Recirculation shunt 75 is in selectable communication with return air duct 73 on one end, and with heat exchanger 68 on the other end. Shunt damper 76 is operable to stop flow through recirculation shunt 75.

In a 10 tph plant, a baghouse 64 of the following approximate dimensions and specifications has been found to work satisfactorily. The housing is approximately 28 feet long, by 12 feet wide, by 28 feet high, with a 5-foot wide inlet. It houses 738 Nomex bags (not shown), each being 6 inches diameter and 14 feet long, with cages, and able to capture dust particles as small as 2.5 microns. Baghouse 64 may also be fitted with a pulsed-air compressor system, as is well known in the art.

In practicing the invention, a baghouse 64 manufactured by Mikro Pulsaire as Model No. 731-R16-14-22PR(C)WG and modified to mate with the cooperating components of plant 10 has been found to work satisfactorily.

Product collection bin 78 resides beneath baghouse 64. Product take-away conveyor 80 and back-feed conveyor 82 are separately operatively connected to, and diverge beneath, collection bin 78. Both conveyors 80 and 82 are preferably of the spiral screw type. Product take-away conveyor 80 may lead to various output structures, holding containers, transport vehicles, or other on-site processing structures at this output end 84 of plant 10. Back-feed conveyor 82 is preferably connected with some product-conveying or mixing structure toward the infeed end 12 of plant 10. It has been found satisfactory to make that connection adjacent the downstream end of shaftless screw-feed conveyor 16. However, other possible points for connection of back-feed conveyor 82 to plant 10's infeed end 12 will be evident to those skilled in the art.

Operation

In use, incoming sludge cake having approximately 25% solids, 75% moisture, is delivered to plant 10 by infeed truck 112. Sludge cake is loaded into weigh hopper 14 and metered onto shaftless screw-feed conveyor 16 at a controlled rate approximating 10 tph, in plant 10.

Sludge cake then passes to mixing chamber 18 where it may be mixed with dry, back-fed biosolids delivered via back-feed conveyor 82. This also begins the process of shredding, i.e. finely dividing, the sludge cake. The incoming mixed or unmixed sludge is preferably further shredded by rotating knives (not shown) in shredder 20 to produce a consistent, homogenous input blend with optimal drying and material-handling qualities. Regulation of the relative portions of sludge cake and dry, back-fed biosolids to achieve the optimal input blend will be within the abilities of one skilled in the art, with reference to the disclosure herein, and will not require undue experimentation.

Tubular drag conveyor 22 delivers raw or blended input sludge to rotary feeder 24 and, in turn, to elongate shredding conduit 26. Rotary blower 27 drives ambient temperature air through elongate shredding conduit 26, past the point where rotary feeder 24 delivers input sludge to elongate shredding conduit 26. The motive air in elongate shredding conduit 26 can range from 1000 to 4000 cfm, and pressures can range from 2 to 6 psi. The motive air throughput and pressure in shredding conduit 26 are functions of the material type, rather than system size. Generally, wetter, more-agglomerated materials require higher air pressure and throughput.

Rotary feeder 24's airlock feature prevents back-flow into the sludge-feed mechanisms. The high-speed, approximately 60 mph, air flow past the lateral infeed from rotary feeder 24 also produces a venturi effect, thus drawing sludge into elongate shredding conduit 26.

As wet sludge and high-speed, ambient-temperature air travel through elongate shredding conduit 26, particle-to-particle collisions, and collisions between particles and the inner walls of shredding conduit 26, result in further shredding. Sweeping, rightangled bend 29, if included, increases the number of particle collisions, and enhances shredding. Ideally, by the time the shredded sludge is expressed at shredding conduit 26's downstream terminus 30, i.e. at injector 37, particle sizes should be less than 1000 microns.

Partially-shredded sludge is broadcast from elongate shredding conduit 26's downstream terminus 30 into flash duct 32 which has 400° F. process air passing therethrough at approximately 35,000 cfm. The air pressure in flash duct 32 is also much lower than in elongate shredding conduit 26. Thus, flash duct 32 is a low-pressure zone, in comparison with elongate shredding conduit 26.

Figure 3:
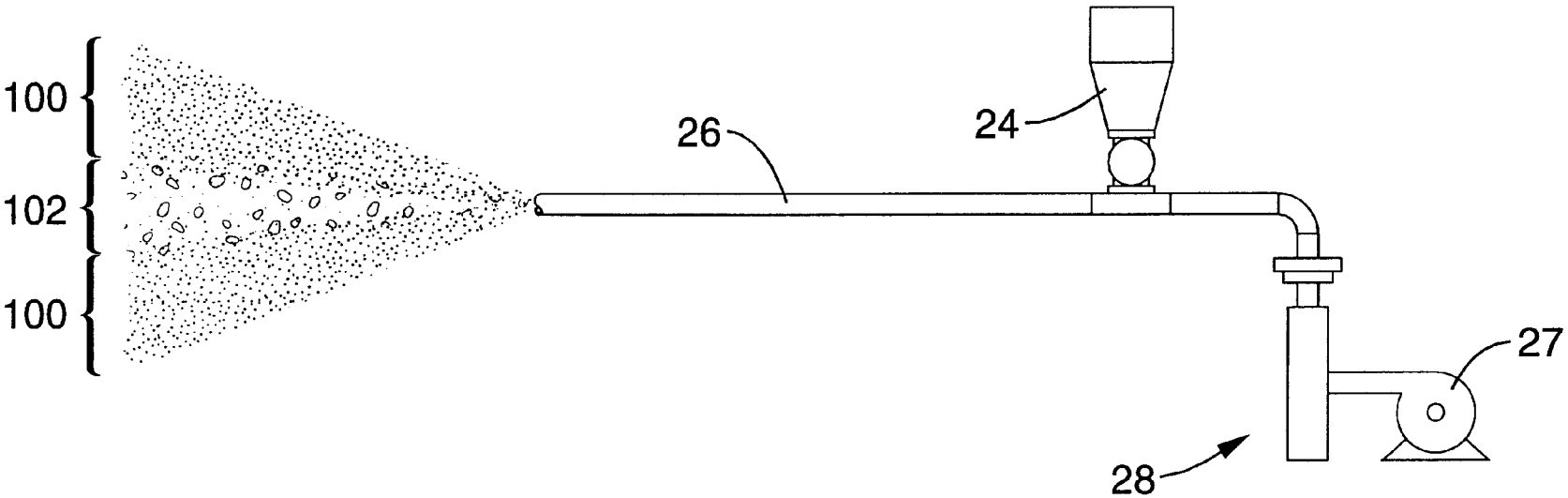
FIG. 3 is a schematic illustration of a cone-shaped spray pattern expressed from a pneumatic friction dryer.

As the partially-shredded product is broadcast from elongate shredding conduit 26's downstream terminus 30, it forms a cone-shaped pattern which begins to classify particles by their size and mass. For simplicity, this "pneumatic friction dryer"-portion is illustrated separate and apart from the other components of plant 10 in FIG. 3. The particles of the smaller, drier, more shredded material 100 tend to fly toward the outer surface of the cone-shaped spray pattern. And, the larger, wetter particles 102, which remain more agglomerated tend to hold the axial centerline, exiting terminus 30 without fanning out into the periphery of the cone.

Figure 4:
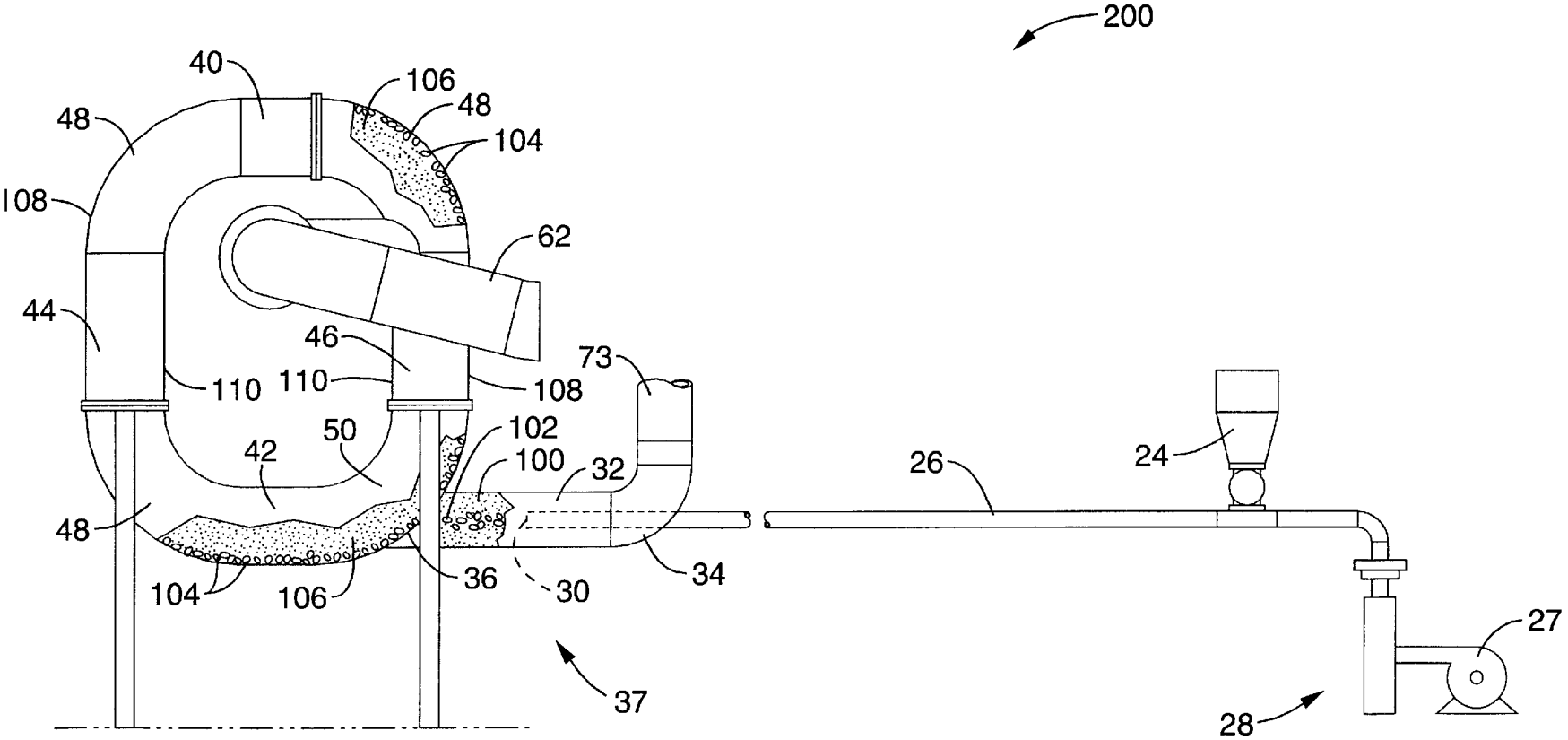
FIG. 4 is a cross-sectional illustration of an injector and toroidal ring dryer in a second embodiment of the invention, the ring dryer being without deagglomeration nozzles, showing the relative paths of different-sized particles.

FIG. 4 is a cross-sectional illustration of an injector 37 mated with a toroidal ring dryer 38, without deagglomeration nozzles 52. Although this is the essence of a second embodiment of the invention 200, further discussed below, it is referred to here to illustrate, without interference of the action of deagglomeration nozzles 52, the path of particles from injector 37 into toroidal ring dryer 38.

As shown in FIG. 4, the partially-shredded product is broadcast from elongate shredding conduit 26's downstream terminus 30 into its cone-shaped pattern within flash duct 32 and, in turn, into toroidal ring dryer 38's inlet corner 50. Pre-classification occurs within flash duct 32. Secondary shredding, drying and classifying occurs in ring dryer 38. The wettest, densest, highest-energy, fastest-moving particles 102 hold the centerline as they shoot into toroidal ring dryer 38. And, the smaller, drier, lighter particles 100 fan out to the inner side walls of flash duct 32. Meanwhile, sludge particles already circulating in toroidal ring dryer 38 are being further classified by centrifugal force, such that the wettest, densest particles 104 migrate to the outside centerline of the of toroidal ring 38. That is, they follow the path of greatest circumference. Moist, heavier particles 104 are shown in FIG. 4 as being closer to toroidal ring 38's outermost wall 108. Smaller, drier, lighter particles 106 float along at slower speeds within the lumen of toroidal ring 38, following a shorter, interior path; i.e., they circulate within toroidal ring dryer 38 closer to innermost wall 110. As particles undergo repeated collisions and their surface moisture is flashed-off, they tend to be slowed by frictional drag.

Injector 37 is mated with toroidal ring dryer 38 such that the heaviest, wettest, fastest-moving particles 102 from injector 37 collide at approximately right angles with the heaviest, wettest, fastest-moving particles 104 circulating with hot process air in toroidal ring dryer 38. That is, the centerline of the cone-shaped pattern and the centerline of the toroid circuit intersect roughly perpendicularly, forcing largest particle-to-largest particle collisions, thus constantly exposing new surface moisture. This innovative technique of directing the highest-energy particles of both the injector 37 and the toroidal ring dryer 38 into collision with each other focuses and makes the most efficient use of the system's deagglomeration energy. And, it is to this innovation that a great deal of the efficiency of plant 10 is credited.

Further, the pressure change as the partially-shredded material enters flash duct 32 and meets the hot, high-speed, lower-pressure process air causes adiabatic, flash-drying to occur.

Ultimately, this process and apparatus produces quicker deagglomeration by increasing the number of particle-to-particle collisions per unit volume. In effect, back-mixing is going on constantly within toroidal ring dryer 38 as drier particles are collided with wetter, incoming particles. Due to this in-ring back-mixing, as well as back-mixing with finished product, the ratio of the number of collisions per unit of energy put into the system greatly exceeds the ratios achievable with competing systems. This results in reduced horsepower requirements for driving motive air, and reduced fuel requirements for heating that motive air.

Further, much of the deagglomeration energy normally entering ring dryer-based drying processes enters through the high-pressure deagglomeration nozzles. However, the reduced deagglomeration energy requirements achievable with the inventive apparatus and method allow a greater portion of the energy to be brought into the system under low pressure. Reducing the pressure requirement reduces the horsepower requirement. This reduces the overall cost of the energy to run the apparatus and to practice the method herein.

All of the foregoing efficiencies are increased when the preferred 90-degree bend in elongate shredding conduit 26 is employed. This single feature has been found to produce a better-shredded product at elongate shredding conduit 26's terminus 30, thus increasing the effectiveness of injector 37 and toroidal ring dryer 38.

In the first embodiment of the inventive plant 10, shown in FIGS. 1 and 2, the material circulating in toroidal ring dryer 38 also passes deagglomeration nozzles 52. Nozzles 52 direct hot, high-speed air into toroidal ring dryer 38's lumen at such a tangent to the flow of the hot, circulating process air as to boost the process air flow in the direction of its circulation. That is, nozzles 52 are preferably directed such that the air they emit merges with the flow of process air within toroidal ring dryer 38, rather than being directed perpendicularly, or at a tangent directed against that flow. The air from nozzles 52 is approximately 900 degrees Fahrenheit, at approximately 20,000 cfm and 2 psi. Nozzles 52 enhance the turbulent flow in toroidal ring dryer 38, greatly increasing the number of particle-to-particle and particle-to-wall collisions within toroidal ring dryer 38, thus accelerating deagglomeration.

However, driving and heating the air delivered to nozzles 52 is sometimes not cost-efficient, especially in comparison with the deagglomerating and desiccating efficiencies now achievable with the injector-ring dryer 37, 38 combination, alone. Thus, in some instances the heat and air to deagglomeration nozzles 52 may be reduced or eliminated, and the electricity and fuel which produce the horsepower and heat needed to run nozzles 52 may be able to be saved. Indeed, in a second embodiment of the municipal sludge-processing plant of the invention, the essence of which is illustrated in FIG. 4, a toroidal ring dryer 38 without any deagglomeration nozzles 52 is employed. The nozzle-less ring embodiment shown in FIG. 4 is generally identified with reference numeral 200.

Ultimately, in either embodiment, the material remains in the circuit until the maximum possible amount of surface moisture has been exposed to dry air, and removed. Particles of a size approximately 60 microns, and under, are drawn out of toroidal ring dryer 38 with the process air as it flows into product output duct 62. Output duct 62's upstream end is mated with toroidal ring dryer 38's innermost wall 110, thus causing duct 62 to draw off the lightest, finest particles circulating in toroidal ring dryer 38. Exhaust fan 70 draws the majority of the process air from product output duct 62 upward through baghouse 64. The fine, dry particles 106 suspended in process air flow to baghouse 64, where a majority drop out into collection bin 78. The finest particles get drawn upward into baghouse 64's Nomex bags (not shown). As suspended particles build up into layers of any substantial thickness on the inner surfaces of the Nomex bags, they tend to reduce air flow through the bags' fabric, thus permitting the buildup to drop out into collection bin 78. Particles as small as 2.5 microns are filtered out of the process air by baghouse 64.

A portion of the dried sludge from collection bin 78 is carried away by product take-away conveyor 80. Product take-away conveyor 80 may terminate at, and deliver its output to, for example, receiving truck 114. The dried sludge product trucked away is a 90% to 98%-dry, Class A biosolid, usable as a fertilizer, filler or fuel.

A separate portion of the output from baghouse 64 and collection bin 78 is conveyed via back-feed conveyor 82 to that point at the end of shaftless screw-feed conveyor 16 which feeds into mixing chamber 18. There, back-fed material begins being mixed and blended with incoming, high moisture-content sludge. Back-mixing techniques and preferred parameters are further discussed below.

Moisture-laden process air from toroidal ring dryer 38 passes through baghouse 64 and, as is well-known in the art, transfers its heat to heat exchange elements (not shown) within heat exchanger 68 before passing out of exhaust stacks 69. Heat exchanger 68 recaptures the sensible and latent heat, and elevates the temperature of the fresh incoming supply air drawn through heat exchanger 68 by plug fan 70 through intake duct 71, such that roughly 70% to 75% of the exhaust heat is conserved.

Recirculation shunt 75 includes appropriate controls on shunt damper 76 to permit fresh, incoming air to be recirculated repeatedly through second burner 72 and plug fan 70 to achieve the elevated temperatures needed before introduction to toroidal ring dryer 10 38. This part of the process is computer-controlled to adjust for changes in incoming sludge composition, VOC emission requirements, and seasonal climatic conditions. Control is discussed further, below.

The primary process parameters throughout the system are: air flow rate; material flow rate; material back-feed rate; pressure; temperature; air moisture content; and, material moisture content. Sensors (not shown) monitoring each one of these parameters are placed, where relevant, throughout plant 10. Plant 10 also includes computer-linked controls on all mechanical and pneumatic process-control elements such as conveyors, feeders, mixers, shredders, fans, blowers, burners and dampers. Those having skill in the art to which the invention pertains will be familiar with the types, ranges, placement and capabilities of the necessary sensors and process control elements. And, those having skill in the art, with reference to the disclosure combined with sensor data during operation, will also be able to adjust the primary process parameters using these computer-linked process control elements to achieve optimum efficiency and economy in operation of plant 10, while producing an optimally-dried and deagglomerated product. The following preferred conditions and constraints can currently be stated.

Plant 10 mixes 400-degree Fahrenheit air at 30,000 to 35,000 cfm with approximately 900-degree Fahrenheit air at 20,000 cfm to produce process air of approximately 650 degrees Fahrenheit. The blend of process air from its low-pressure and high-pressure sources should have sufficient energy to remove 7.5 ton per hour of moisture which, for the design in the preferred embodiment, is optimum.

The volume of 400-degree Fahrenheit air may be adjusted up or down, and the effect on throughput and efficiency noted. Adjustments for temperature may also be made, and the effect noted, as well. The goal is to maximize the process air with the recuperated heat through the low pressure port. If too much air comes from this source using this design, the blend temperature will fall and throughput could be adversely affected.

Regarding limitations in example plant 10, the maximum temperature on the recuperated air should be approximately 450 degrees Fahrenheit, and the approximate maximum temperature of the high pressure air is about 900 degrees Fahrenheit. The minimum temperature for the recuperated air is approximately 180 degrees Fahrenheit. And, the high pressure process air should be kept at ambient temperature.

The flow rate of the recuperated air can be adjusted from zero, to an upper unknown maximum. Air flow on the high pressure port, i.e. through elongate shredding conduit 26, should be fixed at approximately 20,000 cfm. However, it is contemplated that in more-efficient future sludge processing plants, higher recuperated air volumes and temperatures may be used.

For deagglomerators 52 to function, the pressure in manifold 54 needs to be 1 to 3 psi. Generally, higher pressure improves deagglomeration, but it also carries a high horsepower requirement. Manifold 54 pressures of 4 psi or greater seem to become counter-productive. In that embodiment of the invention having deagglomerators 52, the manifold pressure is 2 psi, which falls in the midpoint of the range.

The dual process air sources of the invention, one being a low-pressure source, reduce energy and horsepower requirements of providing process air at 2 psi.

In the drying process there is an optimum ratio of process air that enters through the high-pressure input, i.e. deagglomerators 52, and the low pressure port, i.e. return air duct 73. Plant 10 preferably incorporates apparatus by which this ratio may be adjusted. There are well-known types of air flow and temperature controls (not shown) on the process air source entering through deagglomerators 52. Return air duct 73 incorporates isolation damper 74, which can be partially closed for null point control within the ring. Shunt damper 76 controls air flow through recirculation shunt 75 back to heat exchanger 68. These controls allow the optimum temperature and volume in the mix of air entering the ring from separate sources, so drying and deagglomeration occur in the most energy-efficient manner.

Regarding moisture control, relationships exist between ring loading, drying efficiency, and thermal efficiency. Generally, as moisture loading increases, so do thermal efficiency and moisture content of the end product. Adjusting the throughput of plant 10 can control the moisture content of the end product. In addition, increasing the back-mix ratio reduces the moisture content of the end product at higher thermal efficiencies. Plant 10 can produce an end product of varying degrees of moisture content at high thermal efficiencies by setting the optimum throughput and back-mix ratio.

Material feed rates are linked to both deagglomeration and energy delivered. Plant 10's ability to present material in an improved deagglomerated state improves the feed rate. The energy delivered is a function of the process air volume and temperature.

In laboratory tests with a 4-inch diameter drying ring, increasing air velocities by 75% increased feed rate by 75% while drying and thermal efficiencies were maintained. Similar results are expected in full-sized plants. Establishing optimum air flow rates results in a plant which is smaller and less costly.

Regarding heat, temperatures are set to optimize feed rate, while maintaining the ability to use materials of lower cost and better abrasion-resistant characteristics. Thus, manifold 54 temperatures need be set to be 900 degrees Fahrenheit, or less.

The unique structure of plant 10 also reduces some of the equipment repair and replacement costs normally associated with high temperatures used in related drying apparatus. Specifically, the great length of elongate shredding conduit 26 not only achieves significant preliminary desiccation and deagglomeration of sludge cake before it reaches flash duct 32, that length also necessarily places the material input machinery such as rotary feeder 24 and rotary blower 27, and all other upstream feeding and mixing apparatus, far enough away from high-temperature elements of flash duct 32 and toroidal ring dryer 38 to reduce greatly the effect of incidental heat on that infeed and mixing machinery. Thus, overall long-term operating costs of plant 10 are comparatively lower than in other similar plants.

Back-mixing

Mixing incoming material with dried back-fed material permits output-product quality control, and yields improved thermal efficiency. Different batches of municipal sludge, whether from the same or different sources, have different characteristics with varying degrees of moisture content. By blending the wetter material with an appropriate amount of dry material, a material with optimum characteristics can be produced. With municipal sludge, for example, the optimum range for the sludge being fed into elongate shredding conduit 26 is 45% to 50% total solids. Dry, back-fed material is directed into mixing chamber 18 with the incoming, approximately 75% water-content sludge until the 45% to 50% solids-range is reached. Material of that degree of dryness deagglomerates more readily, and thus affects material loading in the ring and its associated efficiency. Material in the 45% to 50% total solids range also tends to become less sticky, and easier to handle and meter. This also allows for tighter controls on other process conditions, e.g. air flow rate, temperature and pressure, because the material being presented for drying is more consistent.

At different levels of moisture content the cake exhibits different characteristics. When the solids content exceeds 40% the cake begins to lose the pasty/sticky characteristic and becomes more amenable to material handling. The initial target blend is approximately 50% total solids, which will be produced by mixing 7 tph of back-fed material with 10 tph of 25% cake. This is expressed as a ratio of 0.7:1. The total solids content of the cake can range from 12% to 35% which affects the proportions in the blend ratio from 1:1 and 0.4:1, respectively.

Under some circumstances, one may opt to run plant 10 with no back-fed material. This would put the ratio of back-fed material to raw sludge at the low end of the range, at 0:1. In the laboratory, using a reduced-size model of plant 10, pure sludge cake at 19% total solids was successfully dried without any back-fed material mixed in. Thus, plant 10 is believed capable of that mode of operation, if necessary. Nevertheless, increasing the total solids content of the blend with back-fed material is preferred, in order to transport the product properly through elongate shredding conduit 26. Initial results suggest that the optimal minimum solids content of the material passing through elongate shredding conduit 26 is roughly 50%, or so. However, the range may be as wide as 30% to 80%, or so, depending on process parameters and various other conditions.

Regarding ratios of dried to incoming sludge, the high end, practically, is estimated to be 1.5:1 which would produce a blend of approximately 70% total solids. The range, then, is 0:1 to 1.5:1, with a preferred blend of 0.7:1 with 25% moisture content in the incoming sludge cake. The preferred blend for other materials which might alternatively be dried in plant 10 would probably be different. In any case, plant 10 has the capability to accommodate a range of blends, and to adjust the blend to meet product output requirements and to optimize efficiency.

Start-up Blend Ratios

Start-up blend ratios need to be separately considered. The preferred start up procedure is to prime plant 10 with partially pre-dried municipal sludge which has a total solids content of 60% to 70%. This pre-dried sludge is mixed with raw, incoming sludge cake having a total solids content of approximately 25%. After a sufficient amount of end product is produced with total solids in the 90% range, the end product is back-mixed with the raw, incoming sludge cake to achieve the 50% moisture content preferred for feeding into elongate shredding conduit 26. In addition, blend ratios may change with end product requirements. End product requirements can range from 60% to 95%, total solids. The feed rate and blend ratios are the control variables. Using 25% incoming sludge cake, the blend ratios for 60% and 95% products would be 1.5:1 and 0.6:1, respectively.

VOC Emission Control

As a general rule, higher material temperatures in sludge-drying systems result in higher VOC outputs. In plant 10, the material presented for drying has a minimal temperature rise due to its adiabatic nature. Therefore, compared with drying systems employing higher temperatures, plant 10 and the inventive method herein are expected to result in lower stack gas VOC emissions.

System Capacities

It is contemplated that embodiments of the inventive municipal sludge-processing plant disclosed herein may of different sizes and capacities. For example, a plant having a 5-ton per hour capacity is expected to be adequate to meet the sludge-processing needs of municipalities having between 100,000 and 450,000 residents. A 10-ton per hour version is expected to be adequate to serve municipalities having more than 450,000 residents. A prototype 10-ton per hour version has been shown able to convert up to 10 tons of municipal sludge to approximately 2.5 tons of dry product in one hour.

Smaller and larger models are contemplated, to serve the needs of different sized municipalities, and perhaps also to serve the desiccating and deagglomerating needs of industries which regularly handle wet, particulate materials. For example, a 1-ton per hour plant could economically accommodate municipalities having fewer than 100,000 residents. The price point and throughput capacity for a plant this size might also be appropriate for use in rural areas where there may be 6–8 townships, or so, which would process their municipal sludge through a joint venture.

Further Alternative Embodiments

It is contemplated to be feasible that an alternative component, or group of components, which perform the functions of the ring dryer equivalently, could be substituted for the ring dryer in the inventive apparatus. This becomes more likely as the efficiency of the "pneumatic friction drying"-portion of the apparatus of the invention increases.

Figure 5:
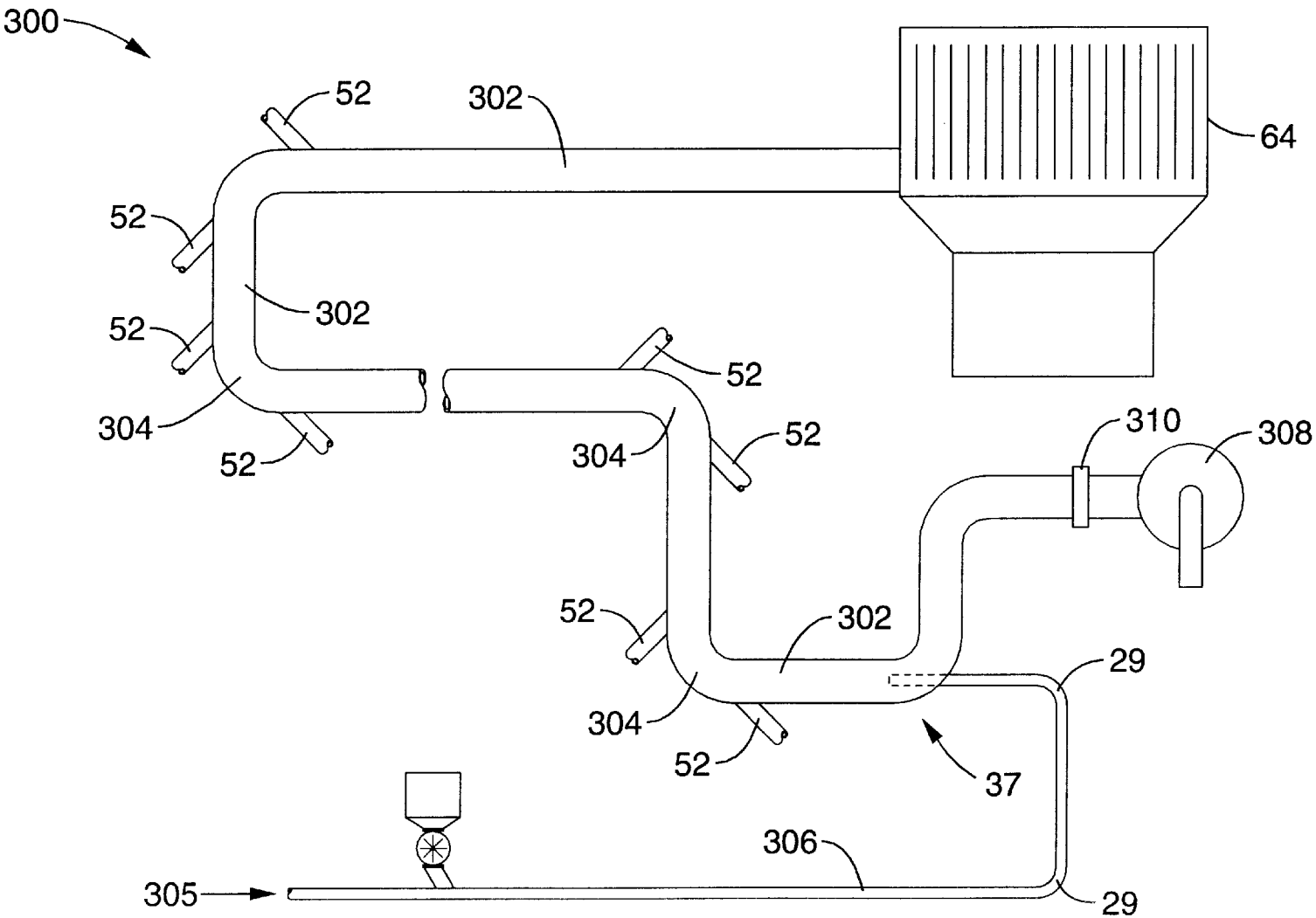
FIG. 5 shows a diagrammatic representation of a third embodiment of the invention, including an elongate flash duct having several 90-degree radius bends, and deagglomerating nozzles at the duct's bends.

For example, a third embodiment of the invention, shown in FIG. 5 and generally identified with reference numeral 300, includes an elongate flash duct 302 with several deagglomerating nozzles 52 at 90-degree radius bends 304 in the duct work leading to baghouse 64. Sludge 305 is delivered via elongate shredding conduit 306 in the same manner as earlier described, and is expressed partially dried and shredded into flash duct 302 in the same classifying cone-shaped pattern illustrated in FIG. 3. Flash duct 302 carries heated, high-speed, low-pressure process air.

With appropriate adjustment of process parameters, assuming flash duct 302 is of sufficient length, it is expected that incoming sludge material may be sufficiently shredded in one pass. Thus, in that case, no recirculation of material is necessary, and a ring dryer is not needed. Neither would a classifier be necessary in that case, although centrifugal forces at the 90-degree bends would tend to classify material. as it travels through elongate duct 302. Secondary shredding, drying and classifying occurs in duct 302. Thus, means could be employed in conjunction with elongate flash duct 302 for blowing off or drawing off the finest particles from the bore of duct 302 at points where those particles travel in classified fractions.

Of course, at a minimum, third embodiment 300 will also require sludge preshredding and back-mixing apparatus (not shown) similar to that discussed earlier, as well as an intake fan 308 and burner 310 to supply a source of heated, fresh, high-speed, low-pressure process air. A source of hot, higher speed, higher pressure air (not shown) to feed deagglomeration nozzles 52, will also be necessary, as well. Apparatus similar to manifold 54, first hot air duct 56, centrifugal blower 58 and first burner 60 of the first embodiment of plant 10, discussed above, are expected to work satisfactorily for that purpose.

Figure 6:
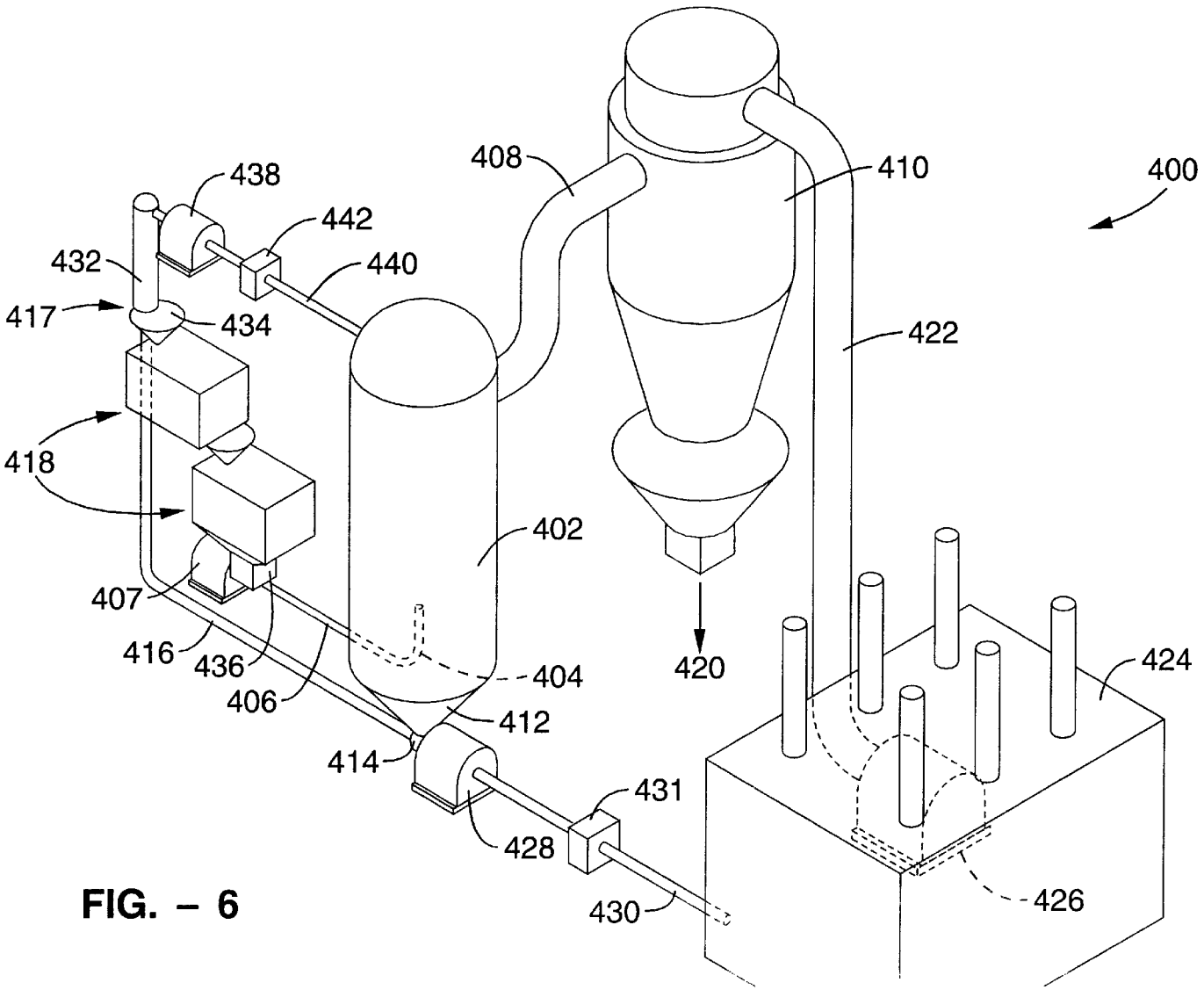
FIG. 6 is a diagrammatic representation of a fourth municipal sludge drying plant, including a cylindrical drying chamber and cyclone separator.

In yet a fourth embodiment of the inventive plant, shown in FIG. 6 and identified generally with reference numeral 400, cylindrical drying chamber 402 is employed in place of a flash duct. Incoming sludge is presented to chamber 402 through an elongate shredding conduit 406 with a sweeping 90-degree radius bend 404 to effect significant partial initial shredding. The length and dimensions of elongate shredding conduit 406 are preferably as described for elongate shredding conduit 26 in the embodiment of the invention identified as plant 10, above. Elongate shredding conduit 406's upstream end is fitted with conduit blower 407, which is preferably able to deliver high-speed, ambient temperature air into an elongate shredding conduit in a manner similar to that described for rotary blower 27, above. Elongate shredding conduit 406's terminus is near the bottom of cylindrical drying chamber 402, and is directed vertically upward therein. This orientation develops a fountain-like spray pattern of shredded sludge within cylindrical drying chamber 402.

Cylindrical drying chamber 402 has a classifier in its uppermost extent which comprises a linking duct 408 to cyclone separator 410. In this embodiment, cyclone separator 410 generally replaces baghouse 64 of earlier embodiments.

Cylindrical drying chamber 402 has heated, low-pressure process air flowing therethrough into linking duct 408. The source of this air is elongate shredding conduit 406, as well as at least one other source, as further discussed below.

Process air flows out of cylindrical drying chamber 402 through linking duct 408, carrying with it the finer, drier, suspended shredded particles. Cylindrical drying chamber 402 size and air flow velocity are set to insure intimate contact between the process air and the material for 15 to 30 seconds. Partially-dried, larger, denser particles remaining too heavy to be drawn off suspended in process air drop to the conical bottom 412 of cylindrical drying chamber 402. From there, they pass through return venturi 414 into elongate return conduit 416. High-speed, high-pressure dry process air in return conduit 416 further shreds and dries these recycled, partially-dried particles, while carrying them back to the input end 417 of plant 400 where, via mixers/shredders 418, they are mixed with raw, incoming sludge cake.

Lighter, finer particles, e.g. below 60 microns, in cylindrical drying chamber 402 are drawn off through linking duct 408 and pass to cyclone separator 410, where they are further dried and classified. Particles 420 sufficiently shredded and dried for use as fertilizer, filler or fuel (e.g. 90% to 98%-dry particles 2.5 microns, and under) drop out the bottom of cyclone separator 410 for further processing, back-mixing or transport.

For example, particles 420 may drop into an apparatus such as collection bin 78 employed in the invention's first embodiment.

The construction and action of cyclone separators are well-known in the art. Cyclone exhaust duct 422 carries hot, moisture-laden exhaust process air to heat exchanger 424. Balancing fan 426 draws air through cylindrical drying chamber 402 and cyclone separator 410 via linking duct 408 and cyclone exhaust duct.

Hot, dry, supply air in plant 400 is drawn by input fan 428 through conduit supply duct 430 from heat exchanger 424 and forced into elongate return conduit 416. Conduit supply duct 430 may conveniently include a first burner 431 to boost the temperature of the air flowing therein. Elongate return conduit 416 carries recycling, partially-processed sludge back to the input end 417 of plant 400.

At input end 417, a drop-out filter 432 screens partially-processed sludge from the air in elongate return conduit 416, allowing that sludge to drop into input hopper 434 for back-mixing with incoming raw sludge. As will be well understood by those in the art, the incoming raw sludge may be mixed with the partially-processed sludge at any desired point adjacent input end 417 of plant 400, e.g. in mixers/shredders 418. Raw or blended, back-mixed sludge is fed by mixers/shredders 418, through input venturi 436, into elongate shredding conduit 406 for delivery into cylindrical drying chamber 402.

Heated process air passing from elongate return conduit 416 and through drop-out filter 432 is drawn by process air blower 438 into process air conduit 440. Process air conduit 440 serves to vent drop-out filter 432, and may conveniently include second burner 442 to keep process air flowing through plant 400 sufficiently hot to effect adiabatic drying. Heated process air flowing from process air conduit across the upper end of cylindrical drying chamber 402 picks up moisture and smaller, drier particles, and carries them into cyclone separator 410 for final drying and classification. The volume of air traveling through linking duct 408 should be balanced against that entering cylindrical drying chamber 402 via elongate shredding conduit 406 and process air conduit 440. Computer controls to effect this balance and to regulate all other process conditions and parameters are presumed.

Figure 7:
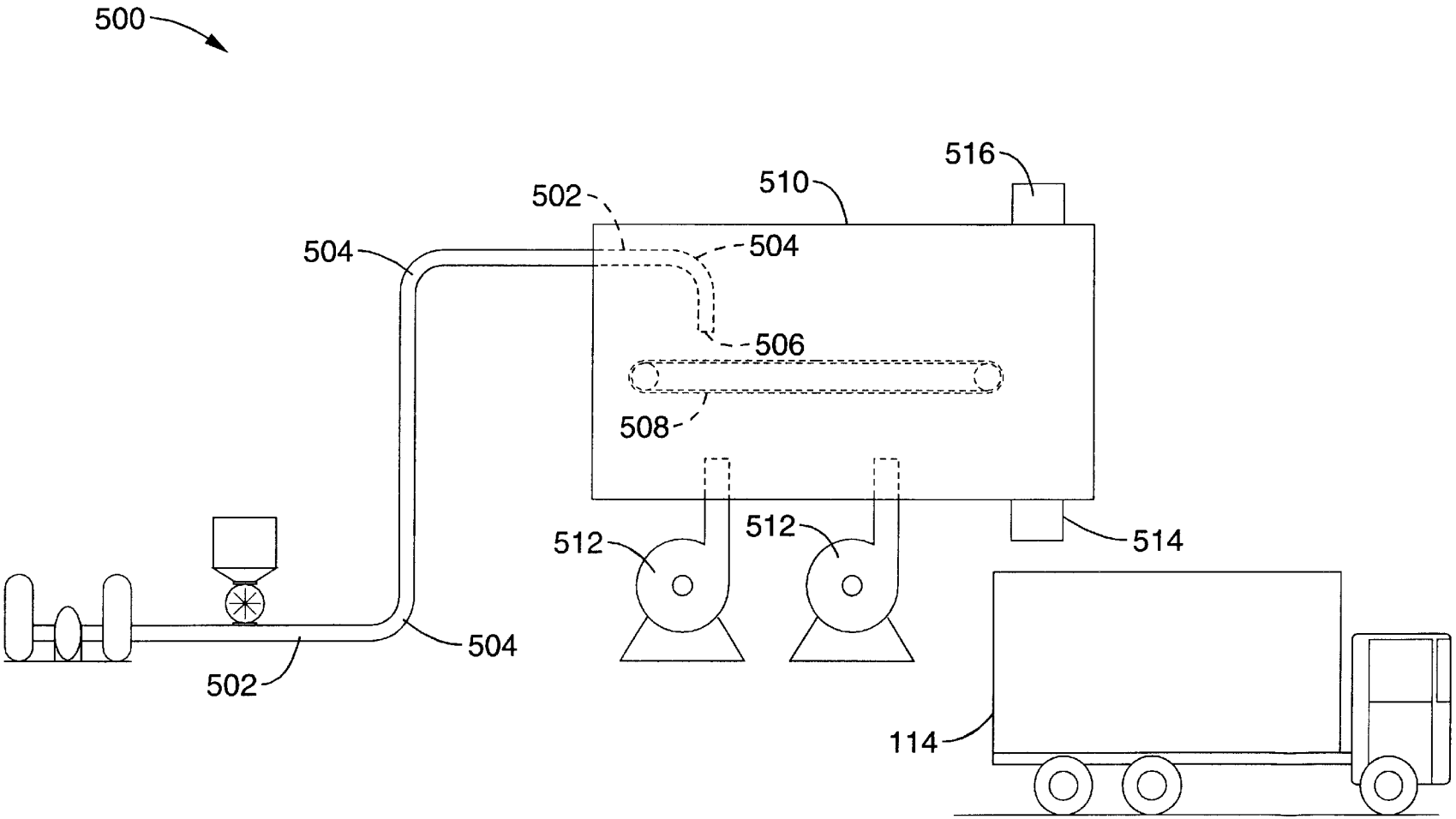
FIG. 7 is a diagrammatic representation of a fifth embodiment of the invention, including apparatus for spraying sludge on a wire mesh belt within a heated drying chamber.

In a fifth embodiment of the invention, shown in its diagrammatic essence in FIG.7 and identified with reference numeral 500, yet another arrangement employs an alternative to a ring dryer. This embodiment also uses the pneumatic friction drying concept, passing sludge with high-speed air through an elongate shredding conduit 502 to effect preliminary shredding and desiccation. One or more sweeping 90-degree bends 504 in this elongate shredding conduit are also preferred. The partially-processed product issuing from the terminal, downstream end 506 of the elongate shredding conduit 502 is broadcast onto a wire mesh belt conveyor 508, thus coating the wire mesh belt. Mesh belt 508 runs in a low-pressure drying chamber 510, with flowing, heated process air from blowers 512 beneath mesh belt 508 blowing through the thin coat of material on the belt. The length of drying chamber 510 is preferably sufficient to permit the material at the end of belt 508 and drying chamber 510 to be 90% dry.

Drying chamber 510's downstream end would require a product output port 514, and a process air exhaust port 516. Input and output product conveyors, heaters, blowers, filters, heat exchangers and other apparatus used in connection with earlier-described embodiments will be understood by those skilled in the art to be useful in connection with this fifth embodiment of the invention.

The foregoing detailed disclosure of the inventive apparatus, best illustrated in various embodiments of a municipal sludge-drying plant, is considered as only illustrative of the preferred embodiments of, and not a limitation upon the scope of, the invention. Those skilled in the art will envision many other possible variations of the structure disclosed herein that nevertheless fall within the scope of the following claims. For example, many different known mechanisms may be used alone or in combination to effect the product-mixing, shredding and blending necessary toward the inventive plants' infeed ends, and to perform the filtering and product-collection functions needed toward the plants' output ends. But, substituting now-known or later-developed apparatus for those purposes is envisioned as being within the scope of the invention. And, the different ways in which the inventive apparatus and method may be used set forth in the alternative embodiments are merely exemplary of possible desiccation and deagglomeration plants based on the inventive concepts. Further, without departing from the spirit of the invention, other drying ring structures, for example some being non-toroidal shape, may also serve the purposes herein satisfactorily. For example, the well-known alternative Barr-Rosin brand ring dryer could be employed, along with an elongate shredding conduit and straight flash duct cooperating as an injector, with a spray dryer, and a commercial fluidized bed. And, a plant or apparatus of any size, if it includes elements disclosed or equivalent to those herein, will also fall within the spirit of the invention.

And, alternative uses for this inventive plant and apparatus may later be realized. Other types of sludge, and sludge-like materials, including sludge that is natural, industrial, non-industrial and/or non-municipal in origin may be dried and deagglomerated as described. That is, any particulate material in a wet, sticky, clumpy, pasty, caked or gelatinous state may be able to be beneficially processed to a dry, deagglomerated state in the apparatus of the invention. Phosphate rock is one example of a common product which needs such desiccation and deagglomeration in its normal processing. Accordingly, the scope of the invention should be determined with reference to the appended claims, and not by the examples which have herein been given.

We claim:

1. Apparatus for drying and deagglomerating wet, clumpy, caked, pasty, sticky or gelatinous material or any combination of such materials, comprising:

a. a downstream terminus of an elongate shredding conduit; and, b. means employing a low pressure zone for classifying, by size and density, material expressed from said downstream terminus of said shredding conduit.

2. The apparatus of claim 1, further comprising means at an upstream end of said elongate shredding conduit for driving gas through said conduit and for loading material into said conduit.

3. The apparatus of claim 2, wherein said classifying means comprises a duct through which heated, high-speed, low-pressure gas flows and into which partially dried and deagglomerated material is expressed from said downstream terminus of said shredding conduit.

4. The apparatus of claim 3, wherein said gas driving and material-loading means are disposed away from said classifying means to prevent incidental heating of said gas-driving and material-loading means by heated elements of said classifying means.

5. The apparatus of claim 1, further comprising a peripheral deagglomeration nozzle.

6. The apparatus of claim 5, wherein said deagglomeration nozzle is peripheral to said injector.

7. The apparatus of claim 5, wherein said deagglomeration nozzle is peripheral to said classifying means.

8. The apparatus of claim 5, further comprising means for adjusting a ratio of air driven through said classifying means to air driven through said peripheral deagglomeration nozzle.

9. The apparatus of claim 1, wherein said classifying means comprises a duct through which heated, high-speed, low-pressure gas flows.

10. Apparatus for drying sludge, comprising, in combination:

a. an elongate conduit having an upstream end and a downstream end;

b. means for driving gas through said conduit at high speed;

c. means for loading sludge into said conduit;

d. means at said downstream end of said conduit for flash-drying shredded sludge; and, d. means at said downstream end of said conduit for classifying shredded sludge.

11. The apparatus of claim 10, wherein said flash-dying and classifying means together comprises a duct, said duct having a diameter greater than the diameter of said conduit at said conduit's downstream end so as to allow shredded sludge expressed from said conduit's downstream end to be classified.

12. The apparatus of claim 11, wherein said downstream end of said conduit projects coaxially into said duct.

13. The apparatus of claim 12, further including means for adjusting the distance said conduit's downstream end projects into said duct.

14. The apparatus of claim 13, further including means for adjusting the distance said conduit's downstream end projects into said flash tube duct.

15. The apparatus of claim 13, wherein said conduit is lined with epoxy resin.

16. The apparatus of claim 11, wherein said duct's length from said conduit's downstream end to a downstream ent of said duct is approximately twice said duct's diameter.

17. The apparatus of claim 10, further including means downstream from said flash-drying means and said classifying means for further classifying and drying said shredded sludge.

18. The apparatus of claim 17, wherein said further classifying and drying means comprises a toroidal ring dryer.

19. The apparatus of claim 18, wherein said toroidal ring dryer includes a deagglomeration tube adapted to direct a gas stream generally transverse to process gas flow within said toroidal ring.

20. The apparatus of claim 10, further including means for back-feeding dried, shredded sludge to said upstream end of said conduit.

21. Apparatus for drying sludge, comprising, in combination:

a. an elongate conduit having an upstream end and a downstream end;

b. means at said upstream end of said conduit for driving gas through said conduit at high speed;

c. means for loading sludge cake into said conduit adjacent to, but downstream from, said gas driving means;

d. means for creating a low-pressure gas zone at said downstream end of said conduit; and, e. means downstream from said low-pressure gas zone-creating means for classifying shredded sludge.

22. The apparatus of claim 21, wherein said downstream end of said conduit includes a sweeping, right-angled bend.

23. The apparatus of claim 21, wherein said low-pressure gas zone-creating means pre-classifies said shredded sludge.

24. The apparatus of claim 21, wherein said low-pressure gas zone-creating means comprises a duct having a diameter greater than the diameter of said conduit.

25. The apparatus of claim 24, wherein said downstream end of said conduit projects coaxially into said duct.

26. The apparatus of claim 25, further including means for adjusting the distance said conduit's downstream end projects into said flash tube duct.

27. The apparatus of claim 21, wherein said low-pressure gas zone-creating means comprises a duct between said conduit and said classifying means, wherein the length of said duct between said conduit and said classifying means is approximately twice said duct's diameter.

28. The apparatus of claim 21, further including means for back-feeding dried, shredded sludge to said upstream end of said conduit.

29. Apparatus for drying sludge, comprising, in combination:

a. a conduit approximately 40 feet long with an 8-inch inside diameter, having an upstream end and a downstream end;

b. means for loading sludge into said conduit's upstream end;

c. means for driving motive gas through said conduit at approximately 1000 to 4000 cfm, at approximately 2 to 6 psi; and, d. a flash duct at said downstream end of said conduit, wherein said flash duct is approximately 10 feet long and has an inside diameter from approximately 18 to 30 inches, wherein a downstream end of said conduit projects coaxially into said flash duct.

30. The apparatus of claim 29, further including means for driving gas through said flash duct at approximately 30,000 to 35,000 cfm.

31. The apparatus of claim 29, further including means for driving gas through said flash duct at approximately 400 degrees Fahrenheit.

32. Apparatus for drying sludge, comprising, in combination:

a. a pneumatic friction dryer;

b. a flash duct dryer; and, c. a ring dryer.

33. The apparatus of claim 32, wherein said flash duct dryer is in fluid communication with said pneumatic friction dryer, and wherein said pneumatic friction dryer is in fluid communication with said ring dryer.

34. The apparatus of claim 32, further including means for delivering sludge to said pneumatic friction dryer.

35. The apparatus of claim 34, further including means for passing sludge from said pneumatic friction dryer to said flash duct dryer.

36. The apparatus of claim 35, further including means for passing sludge from said flash duct dryer to said ring dryer.

37. The apparatus of claim 32, wherein said ring dryer comprises a toroidal ring.

38. The apparatus of claim 32, further including a deagglomeration nozzle in fluid communication with, and directed into an internal portion of, said ring dryer.

39. A method for separating entrained fluid from agglomerated particulate solid matter, comprising the steps of:

a. driving agglomerated particulate solid matter with entrained fluid through an elongate conduit with high-speed gas for a time and distance so as to effect deagglomeration of said solid matter;

b. expressing said deagglomerated solid matter from a downstream terminus of said elongate conduit into a contained gaseous zone at a lower pressure and higher temperature then withing said elongate conduit, thereby causing entrained fluid to be vaporized and carried away from said solid matter by said gas.

40. The method of claim 39, wherein said contained gaseous zone comprises a contained, moving gaseous stream.

41. The method of claim 39, further including the step of segregating particles of solid matter of different sizes or densities expressed from said elongate conduit into different contained zones.

42. The method of claim 39, further including the step of causing said matter expressed from said downstream terminus of said elongate conduit to collide with a stream of partially deagglommerated particulate solid matter.

43. The method of claim 42, further including the step of causing said matter to collide at approximately right angles.

44. The method of claim 42, wherein said colliding stream of partially deagglommerated particulate solid matter is matter earlier expressed from said downstream end of said elongate conduit.

45. The method of claim 44, wherein said collision of matter is effected by expressing matter from said elongate conduit into a ring dryer.

46. A method for drying sludge, comprising the steps of:

a. driving sludge through an elongate conduit with high-speed gas for a sufficient time and distance to shred and partially dry said sludge;

b. directing said shredded, partially-dry sludge through a low-pressure duct; and, c. classifying said shredded, partially-dry sludge by particle size and amount of remaining moisture.

47. The method of claim 46, further comprising the step of broadcasting said shredded, partially-dry sludge in a cone-shaped spray pattern as said shredded, partially-dry sludge is directed through said low-pressure duct.

48. The method of claim 46, wherein the step of classifying said shredded, partially-dry sludge includes passing said shredded, partially-dry sludge through a length of said low-pressure duct approximately equal to twice said low-pressure duct's diameter.

49. The method of claim 46, wherein the step of classifying said shredded, partially-dry sludge comprises:

i. broadcasting said shredded, partially-dry sludge from said elongate conduit in a cone-shaped spray pattern;

ii. directing different fractions of said cone-shaped spray pattern into different portions of secondary shredding, drying and/or classifying apparatus.

50. The method of claim 46, further comprising the step of recirculating said shredded, partially-dry sludge in secondary shredding, drying and classifying apparatus until a predetermined particle size and moisture content are achieved.

51. The method of claim 46, further comprising the step of directing a quantity of shredded, partially-dried sludge through said elongate conduit a second time for further shredding and drying, after said same sludge has been driven through said elongate conduit a first time.

52. A method for introducing agglomerated material into a ring dryer for drying, comprising:

a. driving agglomerated material with high-pressure motive gas through an elongate conduit until said material is partially deagglomerated;

b. expressing said material from a terminal end of said elongate conduit into a low-pressure zone having heated gas flowing therethrough.

53. The method of claim 52, wherein said particle classifier is a ring dryer.

54. The method of claim 52, wherein said particle classifier is a toroidal ring dryer.

55. The method of claim 52, wherein said particle classifier is a cyclone separator.

56. The method of claim 52, wherein said particle classifier is a flash duct.

57. The method of claim 56, wherein said flash duct includes a plurality of approximately 90-degree bends.

58. The method of claim 57, further including a deagglomeration nozzle at a 90-degree bend.

59. The method of claim 52, wherein said particle classifier is comprised of a flash duct in fluid communication with a ring dryer.

60. The method of claim 52, wherein the heaviest, densest, most-agglomerated material expressed from said terminal end of said elongate conduit is directed through said flash duct into collision with the heaviest, densest, most-agglomerated material circulating in said ring dryer.

61. Apparatus for drying and deagglomerating wet, clumpy, caked, pasty, sticky or gelatinous material or any combination of such materials, comprising:

a. an injector;

b. means for classifying, by size and density, the materials expressed from said injector and, c. a peripheral deagglomeration nozzle for directing heated air against material expressed from said injector.

62. The apparatus of claim 61, wherein said deagglomeration nozzle is peripheral to said injector.

63. The apparatus of claim 62, wherein said deagglomeration nozzle is peripheral to said classifying means.

64. The apparatus of claim 63, further comprising means for adjusting a ration of air driven through said classifying means to air driven through said peripheral deagglomeration nozzle.

65. Apparatus for drying and deagglomerating wet, clumpy, caked, pasty, sticky and gelatinous materials or any combination of such materials, comprising:

a. an injector; and, b. means for classifying, by size and density, the materials expressed from said injector, said classifying means comprising a duct through which heated, high-speed, low-pressure gas flows.

66. Apparatus for drying sludge, comprising, in combination:

a. an elongate conduit having an upstream end and a downstream end;

b, means for driving gas through said conduit at high speed;

c. means at said downstream end of said conduit for flash-drying shredded sludge;

d. means at said downstream end of said conduit for classifying shredded sludge; and, e. means for back-feeding dried, shredded sludge to said upstream end of said conduit.

67. Apparatus for drying sludge, comprising, in combination:

a. an elongate conduit having an upstream end and a downstream end;

b. means at said upstream end of said conduit for driving gas through said conduit at high speed, c. means for loading sludge cake into said conduit adjacent to, but downstream from, said gas driving means;

d. a duct for creating a low-pressure gas zone at said downstream end of said conduit said duct having a diameter substantially greater than the diameter of said conduit, said downstream end of said conduit projecting coaxially into said duct; and, e. means downstream from said duct for classifying shredded sludge.

68. The apparatus of claim 67, further including means for adjusting the distance said conduit's downstream end projects into said flash tube duct.

69. Apparatus for drying sludge, comprising, in combination:

a. an elongate conduit having an upstream end and a downstream end;

b. means at said upstream end of said conduit for driving gas through said conduit at high speed;

c. means for loading sludge cake into said conduit adjacent to, but downstream from, said gas driving means;

d. means for creating a low-pressure gas zone at said downstream end of said conduit;

e. means downstream from said low-pressure gas zone-creating means for classifying shredded sludge; and, f. means for back-feeding dried, shredded sludge to said upstream end of said conduit.

70. Apparatus for drying sludge, comprising, in combination:

a. a pneumatic friction dryer;

b. a flash duct dryer;

c. a ring dryer;

d. means for delivering sludge to said pneumatic friction dryer; and, e. means for pasing sludge from said pneumatic friction dryer to said flash duct dryer.

71. The apparatus of claim 70, further including means for passing sludge from said flash dryer duct to said ring dryer.

72. Apparatus for drying sludge, comprising, in combination:

a. a pneumatic friction dryer;

b. a flash duct dryer;

c. a ring dryer; and, d. a deagglomeration nozzle in fluid communication with, and directed into an internal portion of, said ring dryer.

73. A method for separating entrained fluid from agglomerated particulate solid matter, comprising the steps of:

a. driving agglomerated particulate solid matter with entrained fluid through an elongate conduit with high-speed gas for a time and distance to effect deagglomeration of said solid matter;

b. expressing said deagglomerated solid matter from a downstream terminus of said elongate conduit into a contained gaseous zone at a lower pressure and a higher temperature than within said elongate conduit, thereby causing entrained fluid to be vaporized and carried away from said solid matter by said gas; and, c. causing said matter expressed from said downstream terminus of said elongate conduit to collide with a stream of partially deagglommerated particulate solid matter, wherein said colliding stream of partially deagglomerated particulate solid matter is matter earlier expressed from said downstream end of said elongate conduit.

74. The method of claim 73, wherein said collision of matter is effected by expressing matter from said elongate conduit into a ring dryer.

75. A method for drying sludge, comprising the steps of:

a. driving sludge through an elongate conduit with high-speed gas for a time and distance so as to shred and partially dry said sludge;

b. directing said shredded, partially dry sludge through a low-pressure duct; and, c. classifying said shredded, partially-dry sludge by particle size and amount of remaining moisture by broadcasting said shredded, partially-dry sludge from said elongate conduit in a cone-shaped spray pattern and further directing different fractions of said cone-shaped spray pattern into different portions of at least one of secondary shredding, drying and classifying apparatus.

76. A method for drying sludge, comprising the steps of:

a. driving sludge through an elongate conduit with high-speed gas for a time and distance so as to shred and partially dry said sludge;

b. directing said shredded, partially dry sludge through a low-pressure duct;

c. classifying said shredded, partially-dry sludge by particle size and amount of remaining moisture; and, d. recirculating said shredded, partially-dried sludge in secondary shredding, drying and classifying apparatus until a predetermined particle size and moisture content are achieved.

77. A method for drying sludge, comprising the steps of:

a. driving sludge through an elongate conduit with high-speed gas for a time and distance so as to shred and partially dry said sludge;

b. directing said shredded, partially dry sludge through a low-pressure duct;

c. classifying said shredded, partially-dry sludge by particle size and amount of remaining moisture; and, d. directing a quantity of shredded, partially-dried sludge through said elongate conduit a second time for further shredding and drying, after said same sludge has been driven through said elongate conduit a first time.

* * * * *